US005143055A

United States Patent [19]

Eakin

[11] Patent Number: 5,143,055

[45] Date of Patent: * Sep. 1, 1992

[54] SOMATIC ACOUSTIC CHAIR

[76] Inventor: Byron C. Eakin, 3405 Ellenwood Ln., Tampa, Fla. 33618

[ * ] Notice: The portion of the term of this patent subsequent to Mar. 24, 2009 has been disclaimed.

[21] Appl. No.: 771,388

[22] Filed: Oct. 3, 1991

Related U.S. Application Data

[63] Continuation of Ser. No. 459,098, Dec. 29, 1989, abandoned, which is a continuation-in-part of Ser. No. 238,424, Aug. 31, 1988, and a continuation-in-part of Ser. No. 417,690, Oct. 5, 1989.

[51] Int. Cl.[5] ..... A61H 1/00

[52] U.S. Cl. ..... 128/33; 297/217

[58] Field of Search ..... 128/33, 24 R, 25 R, 128/32; 297/302, 303, 326, 327, 433, 434, 217

[56] References Cited

U.S. PATENT DOCUMENTS

| | | | |
|---|---|---|---|
| 2,986,200 | 5/1961 | Nobile | 297/327 |
| 3,880,152 | 4/1975 | Nohmura | 128/33 |
| 4,023,566 | 5/1977 | Martinmaas | 128/33 |
| 4,055,170 | 10/1977 | Nohmura | 128/33 |
| 4,064,376 | 12/1977 | Yamada | 297/217 X |
| 4,124,249 | 11/1978 | Abbeloos | 297/217 |
| 4,790,599 | 12/1988 | Goldman | 297/327 |

*Primary Examiner*—Edgar S. Burr
*Assistant Examiner*—Moshe I. Cohen
*Attorney, Agent, or Firm*—Dominik, Stein, Saccocio, Reese, Colitz & Van Der Wall

[57] ABSTRACT

Somatic acoustic chair provided with sound housings and having person-supporting means carried resiliently by framework supported on a relatively fixed base. The person-supporting means includes a back rest, a seat, and a foot rest so carried individually and apart from one another. The framework is mounted pivotally on the base to enable a person so supported to tilt the chair backward to at least a semi-reclining position.

3 Claims, 5 Drawing Sheets

SOMATIC ACOUSTIC CHAIR

This a continuation of application Ser. No. 459,098, filed Dec. 29, 1989, now abandoned, which was a continuation-in-part of my copending applications for "Somatic Musical Exposure System" Ser. No. 07/238,424 filed on Aug. 31, 1988, and Ser. No. 07/417,690 for "Acoustic Chair" filed on Oct. 5, 1989, both of which are incorporated herein by reference.

TECHNICAL FIELD

This invention relates to means and methods whereby a recumbent listener exposed to music experiences not only audible sensations but also tactile sensations therefrom.

BACKGROUND OF THE INVENTION

Since time immemorial, music has been recognized as being somehow soothing to the spirit as well as pleasing to the ear. Many people believe they work or study better within a musical environment, and some types of music are considered relaxing. Many recent developments in sound generation and reproduction equipment have accentuated and facilitated music appreciation. Music has its repetitive aspect, so it is not surprising that music is common in active and passive exercise. Music encourages such bodily activity as dancing and is now a common accompaniment to individual or group exercise program. Bodily well-being is enhanced by voluntary exercise, but if such exercise is impracticable or is not well distributed throughout the body or is carried to excess, a form of passive exercise or "massage" often proves beneficial.

Similarities between repetitive exercise, massaging movements, and various mechanical actions have led to numerous mechanized beds, chairs, and tables. Efforts have also been made to apply musical or other acoustic/sonic vibrations to more of the body than the ears. However, nobody besides the present inventor seems to understand that the degree of coupling between the musical or other acoustic vibrations and the body is critical or how to accomplish it for the benefits sought. Loose coupling and tight coupling are inoperative because the former does not vibrate the body enough and the latter vibrates it too much, except where the body support is affixed to an inert frame (nullifying the coupling). The problem is even more acute with chairs, where diverse parts of the body are being supported variously, as compared with beds or the like, where all or most of the body is being supported generally horizontally.

Nohmura in U.S. Pat. Nos. 3,880,138 and 4,055,170 and Martimaas in U.S. Pat. No. 4,023,566 disclose sitting or reclining means with loudspeakers directed toward the back of the person thereon, but their systems are too loosely coupled to the supported person to be to be effective. Other inventors have employed liquids for transmitting various vibrations to the body, but such systems are too tightly coupled to be conducive to relaxation and acoustic benefits.

My somatic acoustic exposure system replaces the deficiencies of the prior art with new levels of entertainment and passive exercise plus related benefits for persons so exposed. Such benefits are attainable in a chair, especially one that enables the sitter to adjust its orientation from a sitting through a semi-reclining to a recumbent position, with head, body, and limbs all being supported.

SUMMARY OF THE INVENTION

A principal object of the present invention is to enhance the overall exposure of a listener to musical vibrations despite shifting movement of the listener from and to a sitting position and a recumbent position via an intermediate semi-reclining position.

Another object of this invention is to transmit musical vibrations to the body as well as to the ears of a listener, regardless of whether such listener is sitting or lying down.

A further object of the invention is to accomplish the foregoing objects in a somatic acoustic chair convertible from an upright to a reclining position.

In general, the objects of the present invention are attained via housing means defining an acoustic chamber supplied with music or other desired sound and opening toward means supporting a person exposed to such sound and partially decoupled by intervening resilient means from external supporting means. Such apparatus features a supporting frame, substantially rigid person-supporting means carried resiliently by the frame, a sound housing also carried by the frame and forming an acoustic chamber open toward the person-supporting means. More particularly, the person-supporting means, though substantially rigid, comprises a plurality of relatively movable portions supporting diverse parts of a person's body.

Other objects of this invention together with means and methods for attaining the various objects will be apparent in the following description and the accompanying drawings of a preferred embodiment thereof, being presented by way of example rather than limitation.

SUMMARY OF THE DRAWINGS

FIGS. 11 through 15 show the same chair completely upholstered and cushioned.

FIG. 1 is a side elevation of an acoustic chair of this invention, in a generally upright position;

FIG. 2 is a side elevation of the same chair, inclined from the previous upright position to a partially reclined position; and FIG. 3 is a side elevation of the same chair, fully reclined.

FIG. 4 is a front view of the uncovered chair of FIGS. 1 to 3;

FIG. 5 is a rear view of the same chair; and

FIG. 6 is a sectional plan view, taken at VI—VI on FIG. 4.

FIG. 7 is an oblique view of the chair of the preceding views, partly disassembled, viewed from a vantage point at its upper left;

FIG. 8 is a fragmentary sectional elevation in the vicinity of the assembly points of the same chair, taken at VIII—VIII on FIG. 6;

FIG. 9 is a medial side sectional elevation of the same chair, taken at IX—IX on FIG. 4.

FIG. 11 is an elevation taken from the left and partly forward of the same chair;

FIG. 12 is a plan view of the same chair in upright position;

FIG. 13 is a front elevation of the same upholstered chair; and

FIG. 14 is a rear elevation of the same chair shown previously.

DESCRIPTION OF THE INVENTION

Figure 1:
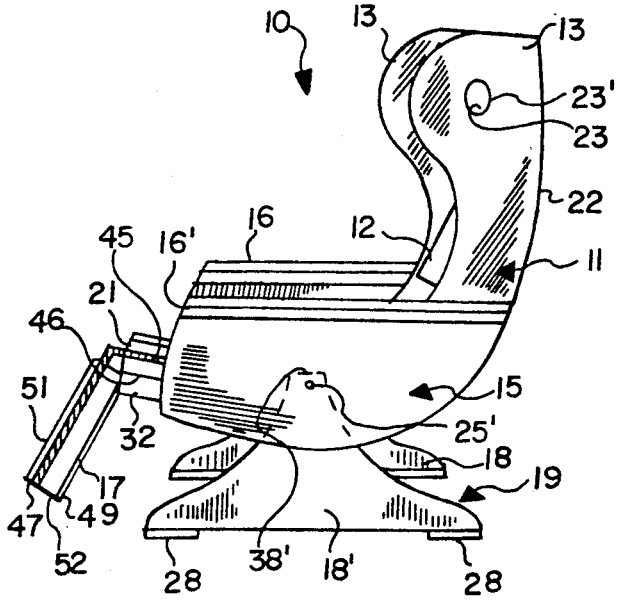
FIGS. 1 through 9 show an acoustic chair of the present invention uncovered so as to reveal its internal structure.

FIG. 1 shows, from the left side slightly above the horizontal, acoustic chair 10 of the invention on base 19 and without upholstery and cushions (shown later), and featuring as principal components: back 11, body 15, foot rest 17, with framework supported directly or indirectly by the base, and with person-supporting members carried resiliently relative to the framework. The back component has back rest 12 as such support for a person's back, has exterior backing 22 as such framework, and is flanked by right and left wings 13, 13' shown with respective speaker openings 23, 23' therein. The body component has pair of right and left sides 14, 14' with arm rests 16, 16' as part of such framework, flanking seat 21 as such support for a person's body. The seat is a bit narrower than the spacing between the sides and rests on resilient strip 45 overlying the perimeter of baffle 46 carried at the front by transverse support 32 attached to the two sides. Foot rest component 17 is attached pivotally to mechanism (not visible) under the seat of the body component, hangs down not quite vertically to the left of the view (front of the chair), and includes outer rest layer 51 as such support for a person's legs and feet, on top of resilient strip 47 to baffle 48, which is spaced by spacer 38 from outer bottom layer 49 as such framework.

The base component has pair of right and left generally triangular uprights 18, 18' resting on corner pads 28. Horizontal pivot pin 25' (to enable the body and back of the chair to recline) is visible in an opening in the near side of the chair, aligned with a vertical fore-to-aft bisector of the base. Top apex 38' (dashed lines) of upright 18' has a horizontal bore receiving pivot pin 25' as top apex 38 of base upright 18 receives pin 25 (not seen here).

Figure 2:
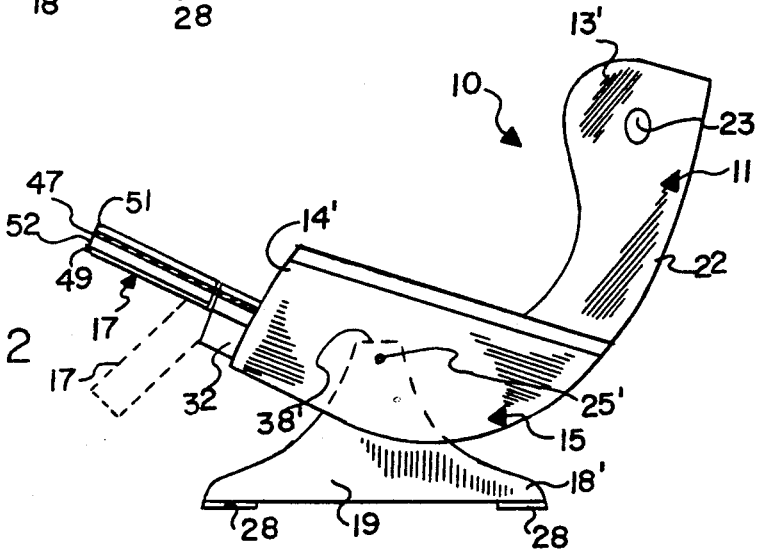

FIG. 2 shows same chair 10 viewed directly from the left and differing from FIG. 1 mainly in having back 11 and body 15 components tipped backward about pivot pin 25' to an intermediate or semi-reclining position. In this position, the back component and the body component, though tipped backward, otherwise remain in their original relative orientation. Foot rest 17 is shown tipped up from its original position (dashed lines) into alignment with seat 21 in this intermediately recumbent position.

Figure 3:
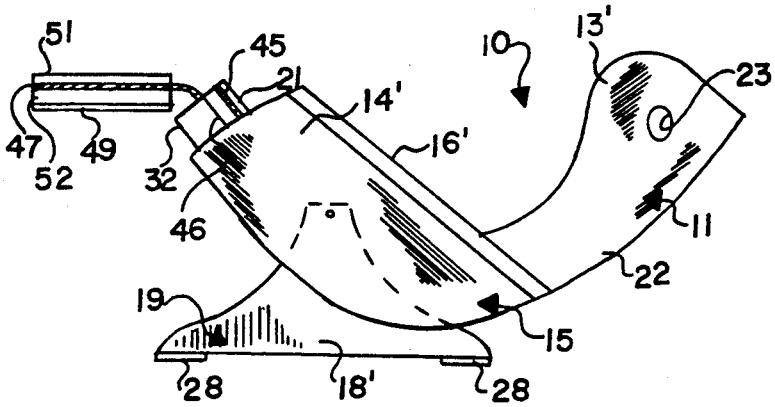

FIG. 3 again shows chair 10 from the left, differing from FIG. 2 in having back component 11 and body component 15, with their related parts, tipped further backward about pivot pin 25' (and opposite pin 25, not visible here) to a fully reclining position, in which foot rest 17 is substantially horizontal, at a setting between the extremes of its positions in FIGS. 1 and 2. In this fully reclined position, the back rest and the seat form an upright V-configuration, while remaining in their original orientation relative to one another, although now tipped further backward.

Figure 4:
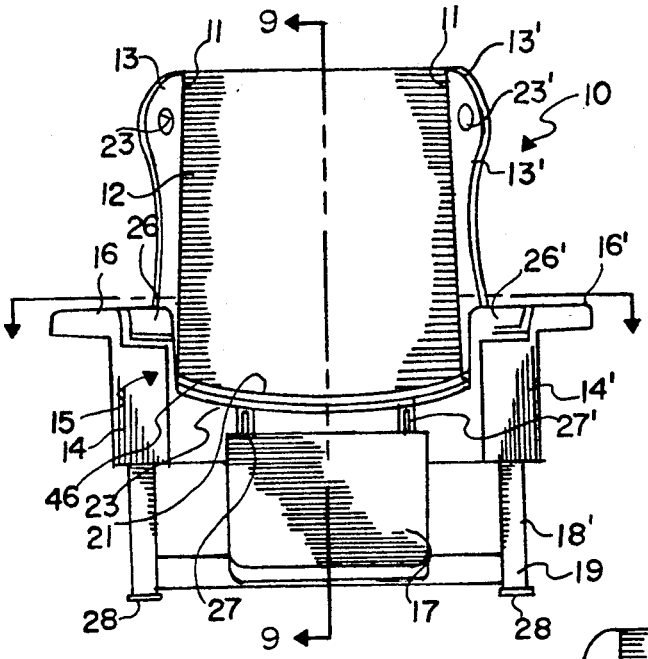

FIG. 4 shows chair 10 upright and viewed from the front. Respective speaker openings 23, 23' are obliquely visible in wings 13, 13' of the back component. Narrower and lower arm rests 26, 26' are recessed along the inside edges of arm rests 16, 16'. Spaced from sides 14, 14' the side edges of seat 21 rest on resilient layer 45 on top of baffle 46 (seen edge-on) on transverse support 32. Right and left pivoted links 27, 27' through openings in the front of that transverse support carry foot rest 17, which has top outer or rest layer 51 resting on resilient layer 47. Baffle 52 (seen edge-on) underlies the resilient strip and is underlain by spacer 49 to bottom outer layer 49. Transverse member 29 joins base uprights 18, 18' just above the floor level of underlying pads 28.

Figure 5:
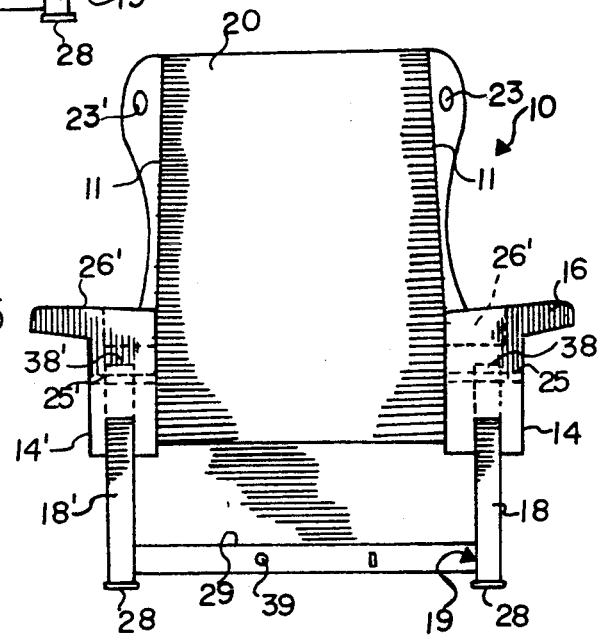

FIG. 5 shows chair 10, still upright, from the back. Pivot pins 25, 25' (dashed lines) occupy horizontal bores in sides 14, 14', below arm rests 16, 16' (and lower arm rests 26, 26'), and aligned bores in upper ends (dashed lines) of base uprights 18, 18'. Wiring pigtail 39 is visible entering an opening in the transverse member.

Figure 6:
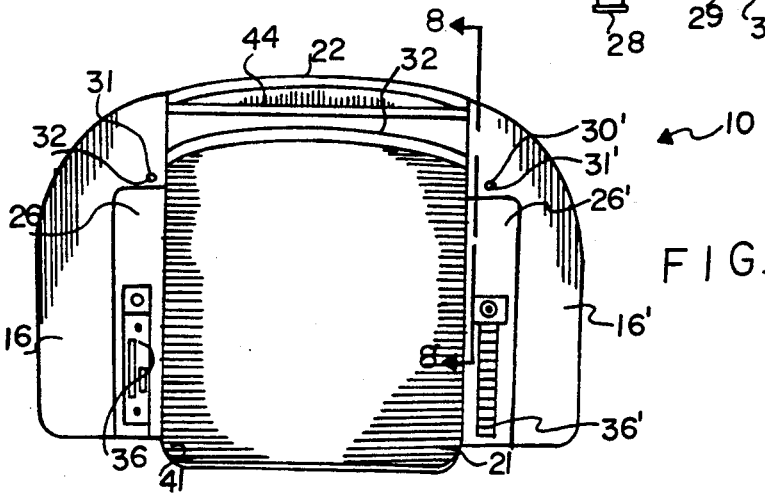

FIG. 6 shows chair body component 15 from above, sectioned through outer backing 22, baffle 44, and lumbar part 32 of back rest 12—spaced from one another and shaded for wood—at substantially arm rest level, as indicated at VI—VI on FIG. 4. Seat 21 is flanked by, and spaced edgewise from, right and left sides 14, 14' with their arm rests 16, 16—and recessed lower arm rests 26, 26'. Visible in the upper arm rests just aft of the recesses for the lower arm rests are pair of bores 30, 30' receiving supporting pins 31, 31' (sectioned here) for back component 11 (shown fragmentarily in section between the arms). The recessed lower arm rests have electrical controls 36, 36' inset in their forward portions.

Figure 7:
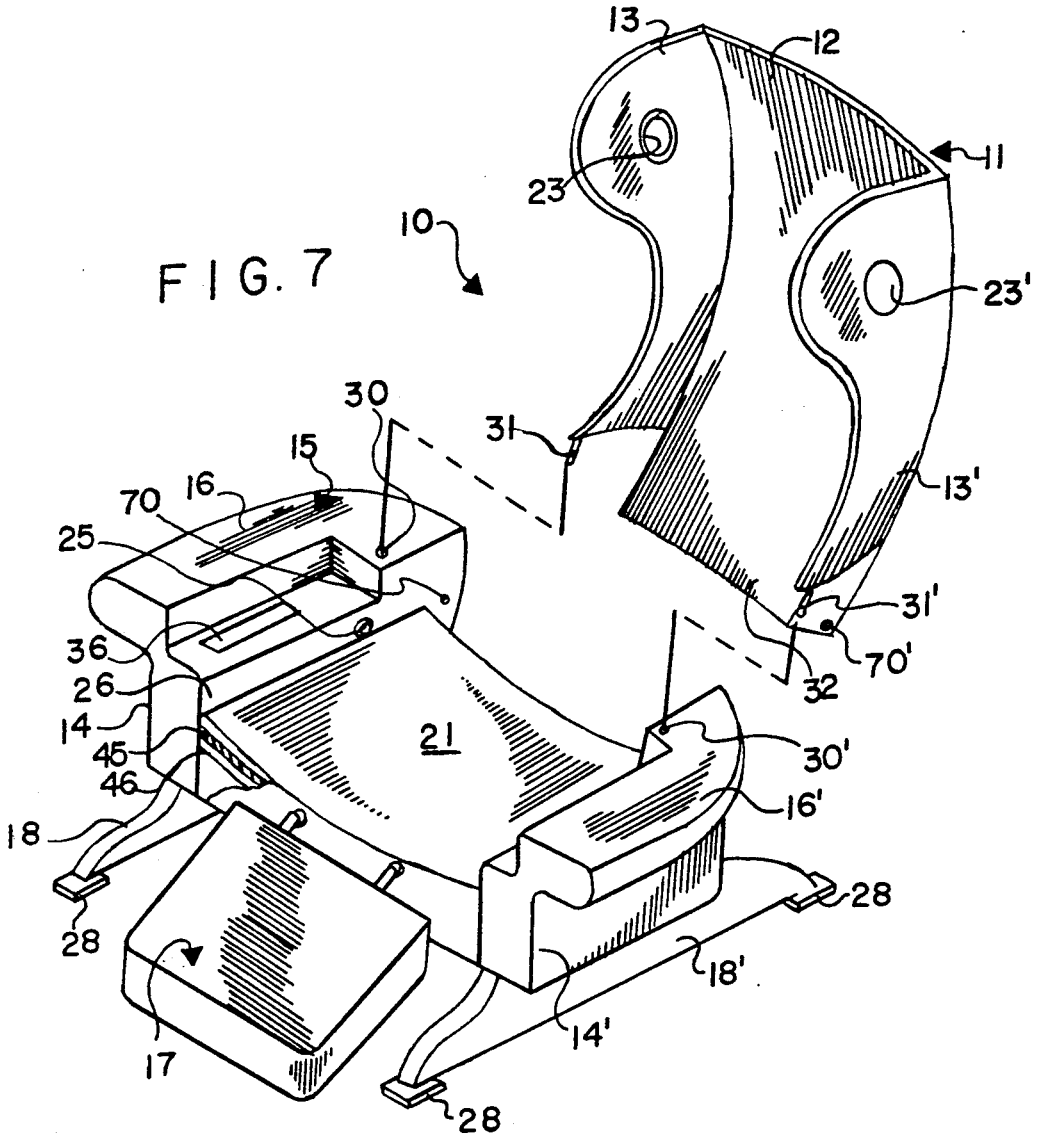

FIG. 7 shows chair 10 in partially exploded perspective, with back 11 shown disassembled from body 15. Pins 31, 31' protrude down from respective wings 13, 13' in position to enter respective bores 30, 30' in the aft portion of upper arm rests 16, 16' where they are normally remain unless and until the chair is manually disassembled, as for shipment. Lateral bore 70' behind and below pin 31' is one of a pair adapted to receive retaining screws (see next view) to supplement gravity in securing the back to the body of the chair. Lumbar portion 32' of back rest 12 in FIG. 7 fits within the inside edges of sides 14, 14' and abuts the aft part of seat 21 when the back is assembled to the chair body. Seat 21 on resilient strip 45 (on baffle 46) is spaced from the sides as well as from the back.

Figure 8:
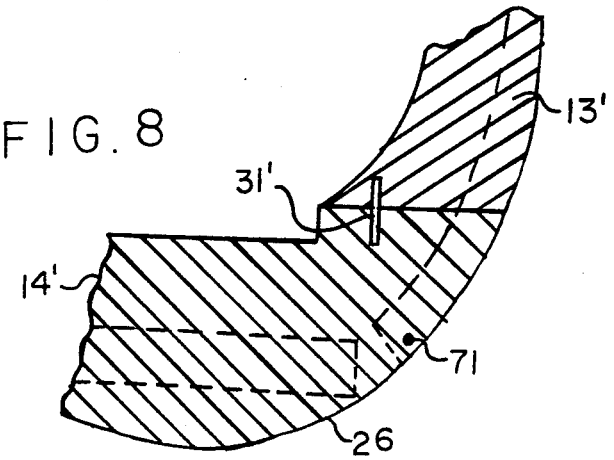

FIG. 8 shows pin 31' and vicinity, partly cut away, with back 11 assembled to body 15, as indicated at VIII—VIII on FIG. 6. Transverse screw 71' (in bore 70'—with like screw 71 in bore 70 on the other side) holds them together, supplementing gravity as noted.

Figure 9:
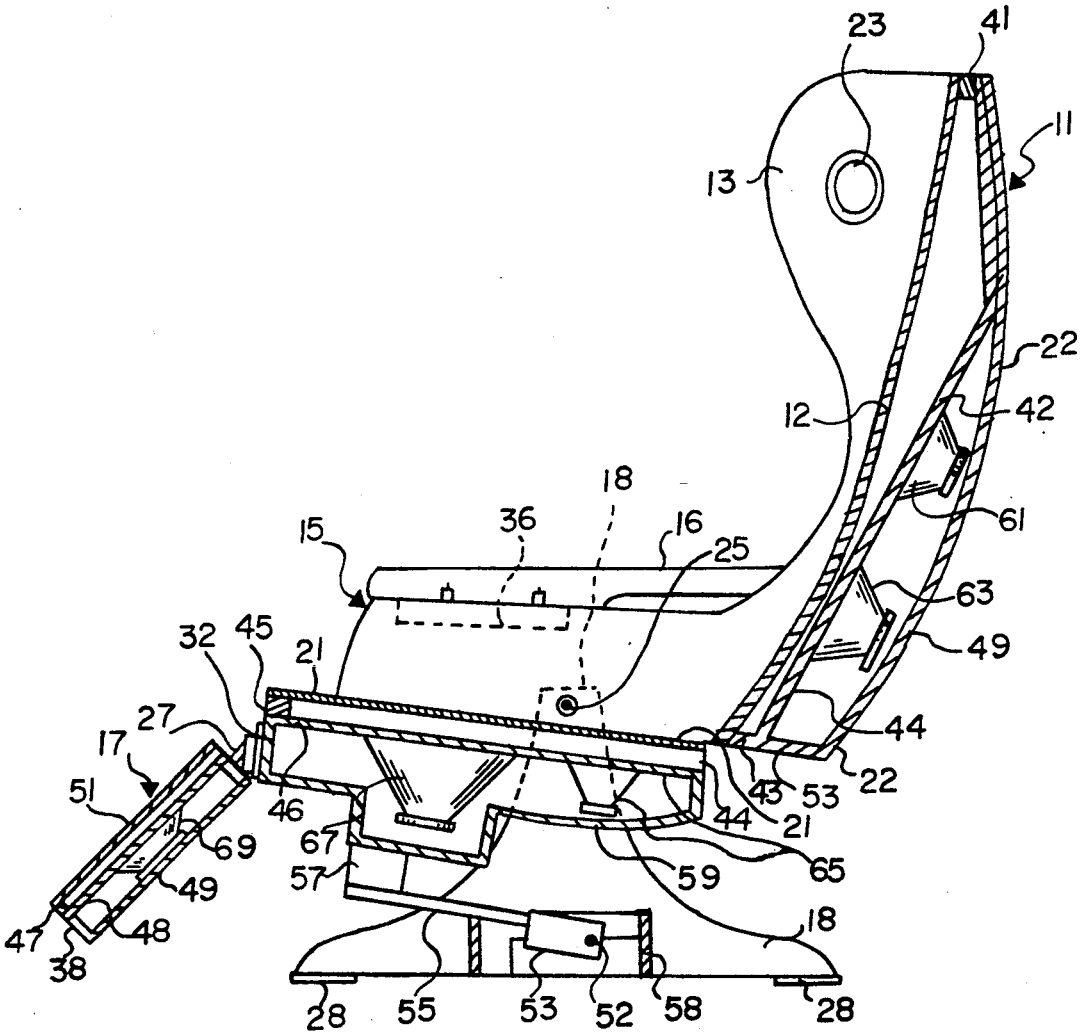

FIG. 9 shows chair 10 in medial vertical section, as indicated at IX—IX on FIG. 4, featuring otherwise concealed members, such as for support and for sound-emission, in the chair interior. Between back rest 12 and outer backing 22 is baffle 42 supported at its upper end against the inside wall of the backing and at its lower end against intervening rigid piece 53 secured to the backing, thereby forming a sound housing. Baffle 42 carries speakers 61 and 63 (in suitable openings) directed toward the back of back rest 12. Baffle 46 underlying seat 21 forms a sound housing with underlying chair bottom 59 and rigid transverse supports 32 along the front edge and 39 along the back edge (and like supports along sides 14, 14'). Baffle 46 supports speakers 65 and 67 directed upward toward the seat. Foot rest component 17 has, as before, outer rest layer 51 on top of resilient strip 47 to baffle 48, which is spaced by spacer 52 from outer bottom layer 49. The base component has cross-members 58 orienting uprights 18, 18' and supporting pivot pin 52, for bidirectional motor 53, which turns shaft terminating in bracket 57 affixed to bottom 59 of the chair to control its orientation in the range from upright to fully reclined.

FIGS. 10 to 14 show chair 110—so designated because it is now fully upholstered and cushioned, greatly modifying its appearance, and with its identified components, parts, or portions designated by one hundred more than the corresponding items previously shown bare. It will be understood that the degree of cushioning is a matter of personal preference and that, though cushioning absorbs some of the acoustic vibration applied to the body via its relatively rigid body support coupled resiliently to the chair frame, the chair remains distinguished by such support as compared with chairs that support the body either on a relatively vibration-proof rigid frame or more directly on a sling or similar flexible or cushioned support.

Figure 10:
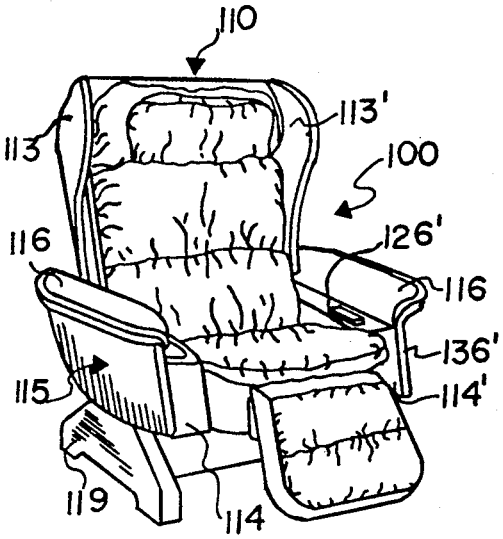
FIG. 10 is a perspective view, from the upper right of the same chair, shown upholstered and cushioned.

FIG. 10 shows acoustic chair 110 in perspective from a largely front and slightly right-side oblique vantage point at a level somewhat above the arms, showing back component 111, body component 115, foot rest component 117, and base component 119. Included are head-high right and left wing portions 113, 113', sides 114, 114' with bi-level arm rests 116, 126 on the right and 116', 126' on the left, and electrical controls 136, 136' on the lower arm rests.

Figure 11:
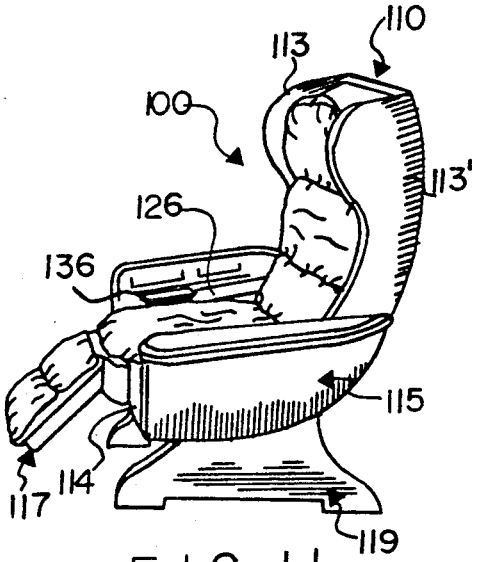

FIG. 11 shows chair 110 from a largely left-side and slightly front oblique vantage point, showing substantially the same features as in FIG. 1, from a different azimuthal position, including more of the fore-to-aft extent of the wings of the back, more of the right armrest, and more of the vertical extent of the base from the side.

Figure 12:
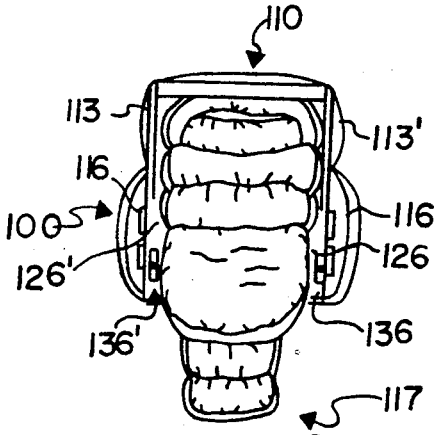

FIG. 12 is a top plan view of chair 110, emphasizing its head, back, and seat cushions, also convexity of the seat cushion outline to the front, and the forward extent of the foot rest.

Figure 13:
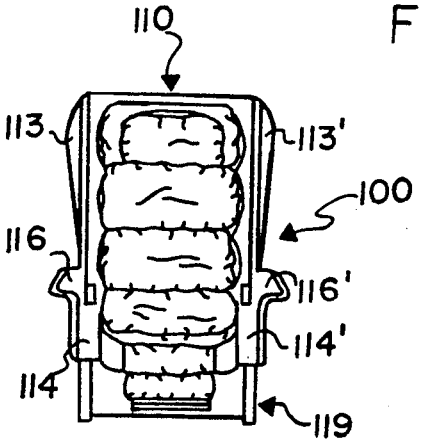

FIG. 13 shows chair 150 from the front, featuring the cushions, armrests, and base.

Figure 14:
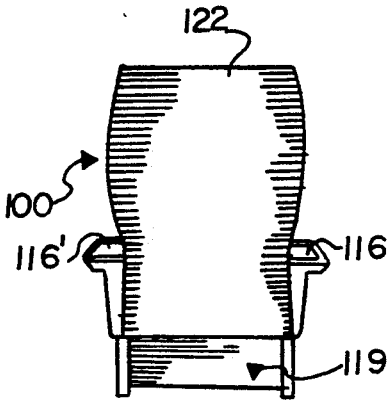

FIG. 14 is the simplest view, showing chair 110 from the back, showing also part of the arms and part of the base.

Operation of the acoustic chair of this invention is readily understood from the foregoing description and the accompanying diagrams. The base carries the chair so that the back and body components can be tipped backward via suitable mechanism at the control of the seated person through semi-recumbent or reclining positions to a more extreme recumbent or reclined position. Music or other desired sound is provided from speakers as shown or from equivalent sonic means and directed from the sound housings toward not only the ears but also the back, seat, and legs of a person so seated.

Although cushioned to a comfortable extent, the back, seat, and legs of a person seated on the chair are carried on relatively rigid members that in turn rest upon resilient strips interposed between the person-supporting members and the general framework of the chair carried pivotally by the base. In this important respect this chair differs from previously known chairs, which either couple a person support tightly to an immovable framework, in which event there is little result; or through interposed liquid, in which event the person is pounded undesirably as soon as enough power is expended to vibrate the incompressible water mass; or loosely to a sling or other insufficiently rigid support, in which event there is little effect except upon the ears of the person as is conventional.

Addition of cushions renders the relatively rigid person-supporting members of this chair more comfortable to a person supported thereon without damping out the sonic vibration transmitted to the person via the resilient coupling to respective framework members.

Also noteworthy is that the chair's back rest and seat, though reclinable together, are not affixed to one another at their junction but instead are individually resiliently carried relative to the framework supported by the base. This arrangement enables them to move relatively independently and substantially perpendicularly to one another in response to applied acoustic vibration. It also is conductive to limitation of the sound laterally to the immediate vicinity of the chair rather than flooding the surroundings with it.

No special materials are required for this acoustic chair. The base and framework are preferably wooden, or alternatively plastic, metal, or composite of equivalent rigidity. The resilient material on which the back, seat, and legs of a person in or on the chair are supported may be any suitably durable elastomer, such as natural or synthetic rubber or foamed polyalkylene, polyurethane, or the like. The resilient material need not cover the underlying baffle or other frame component but preferably is applied in strips along edges or around the perimeter or optionally from side to side intermediately, in width adequate to support the person's weight without excessively absorbing or damping the sound applied to the person therethrough.

The vibrations of the supporting lamina 12, 21, 51 of the supports 11, 15, 17, in association with the resilient strips 43, 45, 47 therearound, renders the air chamber above the speakers 61, 63, 65, 67, 69 of a variable volume when music is played from the loudspeaker to vibrate the supporting lamina. In contrast to this, the air space beneath the loudspeakers, in association with the non-resilient supports 32, 38, 53 therearound, renders such lower air chamber of a fixed volume.

Although maintaining the relative orientation of back rest and seat unchanged throughout reclining orientations is preferred, other arrangements may be employed, even if at some sacrifice in benefits. Thus, the chair back may be hinged to the chair body, instead of pinned thereto, so as to enable the intervening angle to be varied.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. An acoustical somatic chair for exposing users to vibrations from sound for relaxing muscles and stimulating imagery, comprising:

a plurality of supports, each support having a lower chamber formed of a generally planar lower member, a generally planar intermediate member thereabove, and spacer members therebetween to define an essentially closed chamber, the spacer members of the lower chamber being rigid to define a fixed volume therebetween; each support also having an upper chamber formed of the generally planar intermediate member, a generally planar upper member thereabove, and spacer members therebetween to define an essentially closed chamber with a variable volume therebetween; loudspeaker means mounted in aperture means within each intermediate member with, the loudspeaker means facing upwardly for creating sound vibrations in the upper chamber to vary the volume of the upper chamber and with its magnet and coil means depending into the lower chamber; and resilient padding means disposed over the top surface of each generally planar upper member.

2. The chair as set forth in claim 1 wherein the spacer members of the upper chambers are resilient.

3. The chair as set forth in claim 1 wherein the supports are selectively positionable with respect to each other.

* * * * *